United States Patent [19]

Müller et al.

[11] Patent Number: 4,592,222

[45] Date of Patent: Jun. 3, 1986

[54] DEVICE FOR THE DELIVERY AND REMOVAL OF THE MANDREL RODS IN SKEW AND LONGITUDINAL ROLLING MILLS

[75] Inventors: Manfred Müller, Dusseldorf; Wilhelm Nickel, Mulheim; Klaus-Peter Schirmagg, Ratingen; Engelbert Mailander, Hensweiler, all of Fed. Rep. of Germany

[73] Assignee: Mannesmann Aktiengesellschaft, Fed. Rep. of Germany

[21] Appl. No.: 649,815

[22] Filed: Sep. 12, 1984

[30] Foreign Application Priority Data

Sep. 13, 1983 [DE] Fed. Rep. of Germany ..... 3333390

[51] Int. Cl.[4] ..... B21B 17/08; B21B 25/06

[52] U.S. Cl. ..... 72/97; 72/209

[58] Field of Search ..... 72/69, 96, 97, 208, 72/209, 250, 251, 368; 198/456

[56] References Cited

U.S. PATENT DOCUMENTS

| | | | |
|---|---|---|---|
| 1,141,426 | 6/1915 | Simpkins | 72/69 |
| 3,279,585 | 10/1966 | Shen | 72/251 |
| 3,717,018 | 2/1973 | Bellman et al. | 72/97 |
| 3,722,246 | 3/1973 | Passoni | 72/97 |
| 4,037,449 | 7/1977 | Schuetz | 72/209 |

FOREIGN PATENT DOCUMENTS

| | | | |
|---|---|---|---|
| 2816722 | 10/1979 | Fed. Rep. of Germany | 72/367 |

*Primary Examiner*—Lowell A. Larson

*Attorney, Agent, or Firm*—Oldham, Oldham & Weber Co.

[57] ABSTRACT

An apparatus for delivery and removal of mandrel rods for use with rolling mills. A plurality of rocking levers are arranged one behind the other in the direction of rolling and are pivotable into upper and lower positions. Free ends of the levers are provided receivers for receiving the mandrel rod. The pivot or rocking levers are two-armed angle levers which are slidably mounted in two different positions such that in the first position the receivers on the angle levers are maintained in the vertical projection through the rolling axis and in the other position are offset from such vertical projection.

5 Claims, 2 Drawing Figures

DEVICE FOR THE DELIVERY AND REMOVAL OF THE MANDREL RODS IN SKEW AND LONGITUDINAL ROLLING MILLS

BACKGROUND ART

The invention relates to a device for the delivery and removal of the mandrel rods in skew- and longitudinal rolling mills in accordance with the generic notion.

A similar device is already known for a pilger rolling mill according to DE-PS No. 235 999. The device raises, by means of rocking levers, the pilger rods coming into use from a cooling water tank arranged on the recuperator side beneath the rolling axis to the level of the rolling axis and lowers those used in rolling into the water tank. Dishes or star-shaped mandrel rod holders are arranged for the exchange of the rods in the rolling axis, which holders may hold several mandrel rods simultaneously, as receivers on the rocking levers. The swivel axes of the levers are arranged approximately half way between the base of the water tank and the level of the rolling axis.

Such a rod exchanging device is not well suited for high performances for several reasons. The rods which are to be removed and delivered arrive into the same receiver, in which possibly in addition there are also reserve rods, which are mainly to be slid transversely in the receiver. Furthermore, in the upper rocking lever position in pilger rolling mills the threading of the hollow body or the stripping of the hollow billet or in the case of plug rolling mills the removal of the rods and return into position in front of the roll stand must take place in the rolling axis. Finally, the travelling paths in the rolling axis are long. In total, long unproductive periods result for the rod exchange and possibly the confusion of rods.

DISCLOSURE OF THE INVENTION

The object of the present invention is to shorten the length of time for rod exchange, restricted to skew- and longitudinal rolling mills, and in the rod exchange on the roll stand to realise a passage of the rods in one direction. The object is, in addition, a mode of operation on the device, which is particularly productive.

The problem is solved by a device with the characterizing features of the main claim. Expedient further developments are contained in the sub-claims. To make full use of the advantages, a mode of operation according to the final claim is recommended.

In skew- and longitudinal rolling mills, the supply of the pieces which are to be rolled usually takes place from the side opposite the support and the removal of the roller pieces together with the mandrel rod takes place transversely to the rolling axis on the side of the support. This also applies to rolling mills for which the device according to the invention is intended.

The rocking levers rest at the end of the rolling process in the lower position and the first position of the transverse displacement, so that the receivers stand vertically closely beneath the rolling axis on the upper, approximately horizontal angle lever arm. The resultant hollow body ( also called the hollow billet ) is to be found entirely on the mandrel rod which is located in the rolling axis. After rolling, the support travels back and deposits the mandrel rod with the hollow billet onto these receivers of the approximately horizontal angle lever arms. The lower angle lever arms are loaded with a new mandrel rod.

The exchange of mandrel rods takes place by pivoting the angle levers into the upper position, for which only a small amount of time is required. Also, only a small path of displacement of the support is required, since in the pivot movement of the angle levers the used mandrel rod is pivoted out of the stand in the direction of the rolling axis and the mandrel rod which is coming into use is pivoted into the stand. When the mandrel rod which is newly coming into use is fixed in the support, the rolling process begins with a new piece, which is passed to the rolling mill stand from the other side.

Before rolling begins, or even during rolling, the angle levers are pivoted back by a small angle and are then moved horizontally transversely into a second position and brought completely into the lower position. The lower lever arms are loaded with a new mandrel rod for the next rolling process and then, or already previously, are moved back into the first position.

The mandrel rod, which during the exchange of mandrels rests on the receivers of the upper angle lever arms, with the rolling material located thereon, is likewise removed from the rolling material during the next rolling and before the angle levers are brought into the lower position. For this purpose, the receivers of the upper angle lever arms in the upper position may form a withdrawal roller track or a part thereof, which is extended beyond the region of the support, runs largely off over the support, which is to be constructed appropriately, and over which the mandrel rods are removed.

After the separation of the finished rolling material from the mandrel rod, and after the rods are carried out from the region of the device under consideration, the mandrel rod is brought after, or for, cooling in the mandrel rod cycle into the charging level, ie. the lower position of the receivers of the pivot arms situated under the horizontal, or is exchanged for re-finishing.

This device is especially suitable for skew rolling mills, because the circulation of mandrel rods is not impeded by the roll driving spindles, which cross the horizontal through the rolling axis, as is the case with the usual horizontal delivery and removal.

The device makes possible an extraordinarily quick exchange of rods in skew- and longitudinal rolling mills of all types, because on being raised into the rolling axis around the rolls the mandrel rod is brought some way between these, so that the path of displacement of the heavy support is shortened in distance and therefore in time. Furthermore, it is considered to be an advantage that the exchange of mandrel rods automatically takes place, so that it is ensured that the used mandrel rod is not re-used immediately inadvertently, and the mandrel rod which has just been supplied runs unused through the rod supply.

Advantages in terms of time in comparison with the use of conventional devices also result in the case of plug rolling mills. The steps for the return transportation of the hollow body according to claims 4 and claim 6 are of great advantage especially for these two-high rolling mills.

On a plug rolling mill, in many cases operations are carried out with two passes. In this, the hollow body is withdrawn in the rolling axis from the first mandrel rod and is transported back by a special driving apparatus through the opened grooved rolls. It is also already known to transport the hollow body back around or away over the rolling stand. However, the result of this is always long idle times.

With the steps according to the invention, however, the roll line is cleared immediately after the rolling out of a piece, and after the simultaneous supply of a new mandrel rod it is available for the rolling of another piece, and in addition in the meantime the return of the piece, which has already been rolled once, to the supply side is carried out. This results in a rolling rhythm which deviates from the conventional one in the respect that always a piece which is supplied later is already pre-rolled before a previously supplied piece is finish-rolled.

The invention will be explained in further detail in an example embodiment represented diagrammatically in the figures.

DESCRIPTION OF THE DRAWINGS

For a complete understanding of the objects, techniques and structure of the invention reference should be had to the following detailed description and accompanying drawings wherin.

BEST MODE FOR CARRYING OUT THE INVENTION

Figure 1:
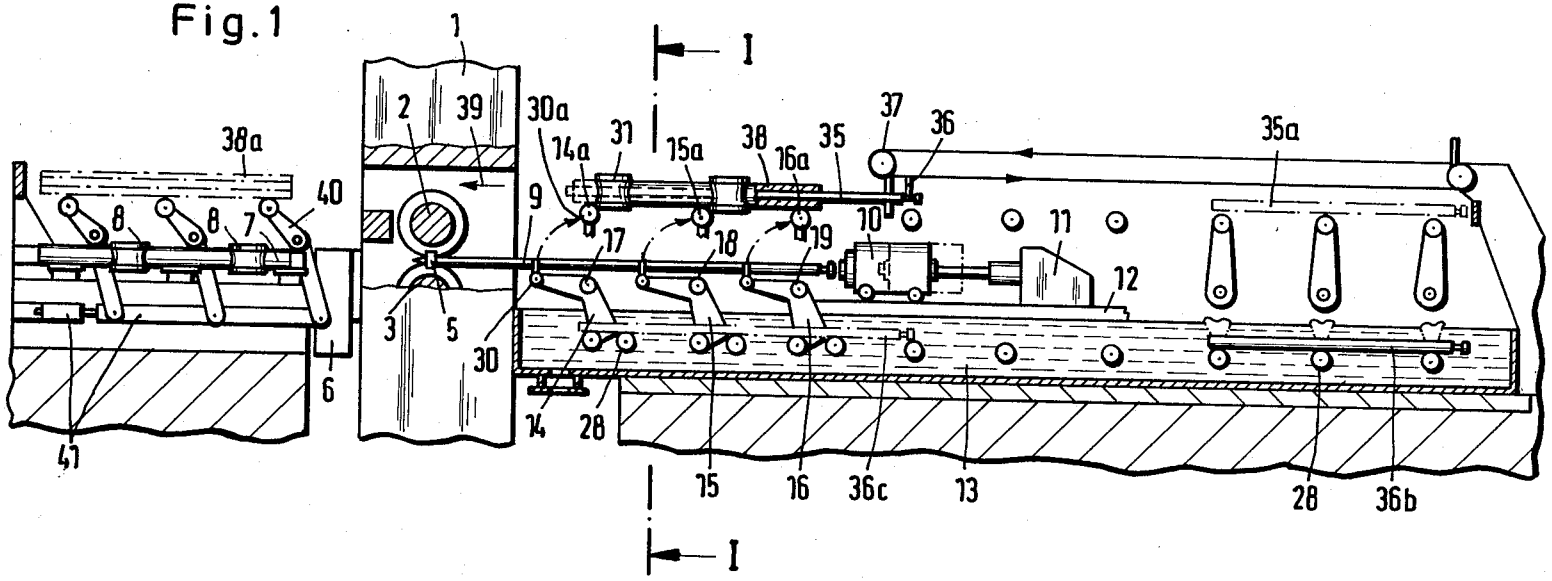
FIG. 1 is a side illustrative view of a rolling mill incorporating the concept of the invention.

FIG. 1 shows a two-high plug rolling mill stand with the upright 1 and the grooved rolls 2,3. Between the grooved rolls 2,3 there stands a mandrel 5 in its working position, which is placed into the rolling axis by a device 6, so that the piece of rolling material 7, which is brought up from the left from the rollers 8 to the grooved rolls 2,3 presses it into the mounting of the mandrel rod 9 and slides away over it. The mandrel rod 9, in turn, is supported by the support 10, which consists of a movable carriage 10 and the support 11 which is fixed on the base 12.

Between housing post 1 on the delivery side and the support 10, a device is located for the delivery and removal of the mandrel rod 9 via a cooler box 13. It consists of three angle levers 14,15,16. The angle levers pivot jointly about the axis 17,18,19 and have on their arms prismatic rollers as receivers 30,42 in FIG. 2.

The pivot drive for the angle levers is not illustrated in FIG. 1. The angle levers 14,15,16 are shown in the lower position and are able to be brought into the upper position through pivoting, with an upper arm pointing upward, which is indicated in dotted lines and designated by 14*a*,15*a*,16*a*.

Figure 2:
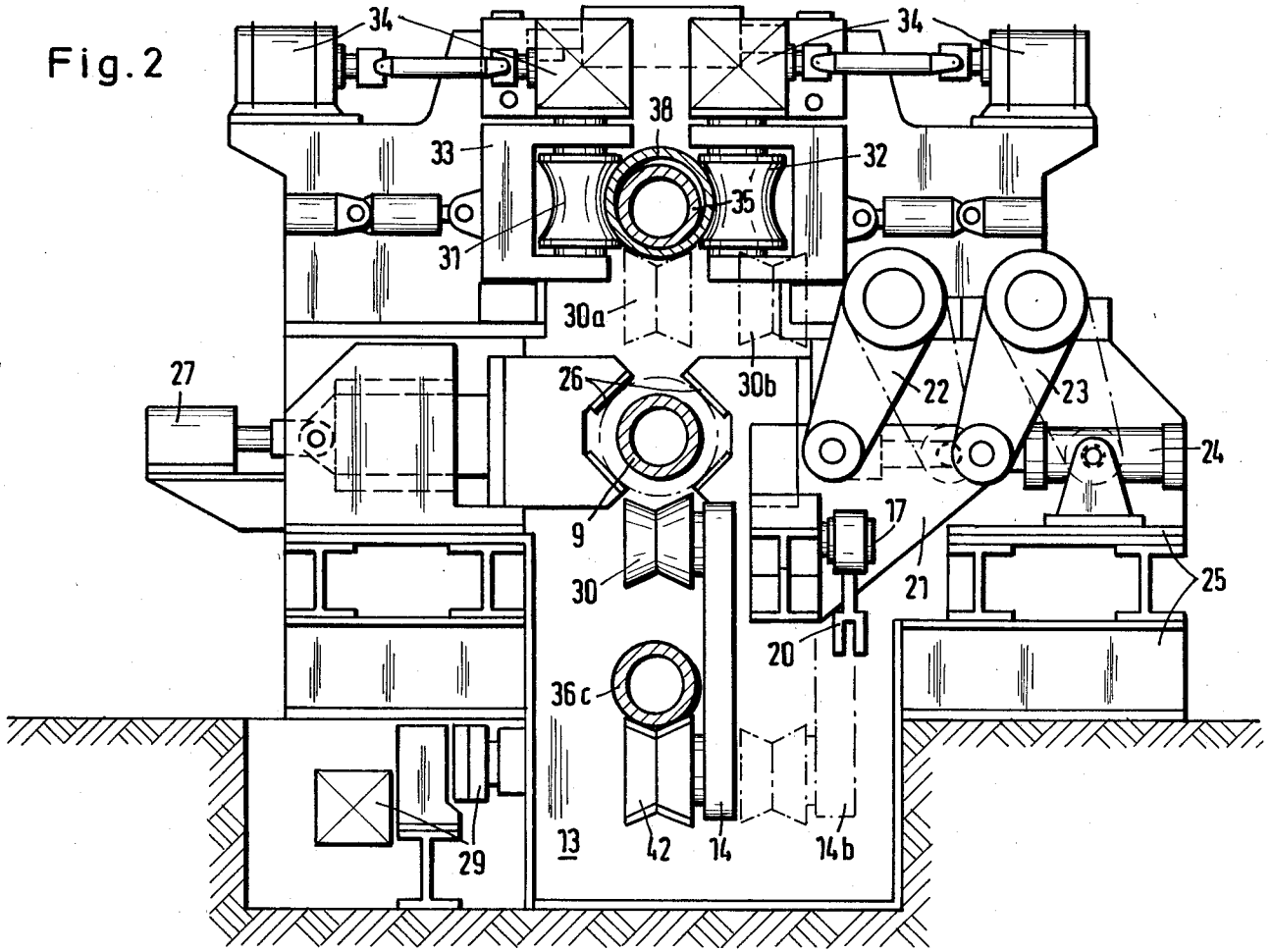
FIG. 2 is a cross sectional view of the rolling mill of FIG. 1 taken along the line I—I.

The angle levers 14,15,16 also have a second degree of freedom and may be brought vertically to the second plane into a first position in the projection of the rolling axis and a second position by approximately a maximum width of rolling material adjacent thereto, as can be seen in FIG. 2.

FIG. 2 shows the section I in FIG. 1 with the angle lever 14 in a position such that a lever arm points vertically downward and the pivot axis is 17 and the pivot drive engages in 20. The pivot axis 17 is mounted on a bracket 21 which is held by parallelogram guides 22,23. Through the drive 24 the rocking lever 40 on the bracket 21 is brought into the second position designated 14*b*. It is also pivotable in this position.

In FIG. 2 in addition the mandrel rod 9 is shown in the rolling axis, and the rod and hollow billet guide 26 with the drive 27 and the drive 29 for fixed rollers 28 in the cooling cooling box 13.

In FIGS. 1 and 2 in addition a rod extraction device can be seen. It lies above the rolling axis and consists of the receiver 30*a*, the angle lever 14*a* and likewise angle levers 15*a* and 16*a* the drive rollers 31,32 with adjustment 33 and drive 34 in FIG. 2 and the shank 36 engaging into an indent of the mandrel rod 35 with a drag drive 37 in FIG. 1.

With this device, hollow bodies and rods are separated from each other as soon as they are raised into position 14*a*,15*a*, 16*a* in the rolling axis both by the rolls 3,4 and also by the support 10 and by the angle levers 14,15,16, such that the shank 36 takes up the rod 35 and brings it to the right in FIG. 1 into position 35*a*, from which it is brought into the cooling bed 13 into position 36*b* and for re-use in 36*c*.

At the same time the driving rolls 31,32 are started and drive the rolled hollow body 38 in the direction of the arrow 39 into position 38*a*, from whence it is removed laterally as a rolled pipe for sizing rolling or is lowered again into the rolling line into position 7 for further plug rolling with the lever 40 with drive 41.

The mode of operation of the device according to the invention is completed in an advantageous manner as follows: In a starting phase provision is made for a mandrel rod on the receiver 42 on the downwardly pointing arm of the angle lever 14 to be brought from position 36*c* into position 9. Fixed in the support 10, a piercer 5 is put in place and a piece of rolling material 7 is delivered. Up to the end of rolling this piece, the angle lever 14 is returned and for this purpose moves with the receiver 30*a* into position 30*b*, pivots back into position 14*b*, moves forward into position 14 and the receiver 42, FIG. 2, is loaded again with a mandrel rod 36*c* and the receiver 30 is ready to receive a mandrel rod 9 after rolling, with the ho11ow body which has just been rolled located thereon. A regular operating cycle of the device therefore comprises the following steps, in which this cycle also represents, at the same time, the preferred mode of operation of the rolling mill. The rolling of a piece is completed, the angle levers 14,15,16 are brought from this position into position 14*a*,15*a*,16*a*, in which the rolled hollow billet 38 is brought with the mandrel rod 35 from the rolling axis onto the withdrawal level.

With the pivoting of the angle lever at the same time a new mandrel rod 9 is raised into the rolling axis. Simultaneously with this pivoting, a piercer can be placed in position by 6 and a further rolling process can commence.

When the withdrawal of the mandrel rod from the previously rolled piece of rolling material is completed, the return of the hollow body 38 begins in accordance with arrow 39 either for treatment elsewhere, because the piece is finish-rolled, or for further rolling e.g. with a larger mandrel, in the next rolling operation.

As the rolling takes some time, there is sufficient time to return the angle levers from 14*a*, 15*a*,16*a* into the position 14,15,16, as has been described above in the initial phase.

In this mode of operation, in the case of two passes A and B for consecutively numbered pieces of rolling material the following sequence results through the grooved rolls: IA, IIA, 1B, 2B, 3A, 4A . . . or 1A pause 2A, 1B, 3A, 2B, 4A, 3B, 5A, 4B . . . The idle times in this mode of operation are still only very small compared with the actual rolling time.

We claim:

1. Device for the delivery and removal of mandrel rods in skew and longitudinal rolling mills between a roll stand and mandrel support with a plurality of rocking levers arranged one behind the other in the direction of rolling and which are pivotable into an upper and a lower position, on the free ends of which levers receivers are provided for receiving the mandrel rod, and which are mounted in horizontal pivot bearings extending transversely to the rolling direction and which have a pivot drive, characterized in that the rocking levers are two-armed angle levers forming an angle of 60° to 150° therebetween with a receiver mounted on one side of both arms, the pivot axes of which, approximately at the level of the rolling axis and in the horizontal transversely to the direction of rolling, are slidably mounted in two different positions, in by drive means which in a first position the receivers stand on the angle levers in the vertical projection through the rolling axis and in the other position are offset adjacent said vertical projection through the rolling axis.

2. Device according to claim 1, characterized in that one set of shanks of the angle levers in the upper position stand approximately vertically and in the lower position approximately horizontally.

3. Device according to claim 2, characterized in that the receivers of the one set of shanks of the angle levers, which in the upper position stand approximately vertically, form a roller track, which is extended by further fixed rollers, or rollers which may be raised and lowered, one behind the other, beyond the mandrel support, and in the region of which a mandrel withdrawal device engages.

4. Device according to claim 3, characterized in that the roller track formed by the receivers on the one shank of the angle levers, which stand approximately vertically in the upper position, extends beyond or through the roll stand through further rollers which may be raised and lowered on the sides of the roll stand opposite the mandrel support.

5. Device according to claim 4, characterized in that the receiver of the other shanks of the angle levers, which stand approximately vertically in the lower position, forms a roller track, which runs beyond the mandrel support through further fixed rollers or rollers which may be raised or lowered.

* * * * *